US010081486B2

(12) United States Patent
Murray

(10) Patent No.: US 10,081,486 B2
(45) Date of Patent: Sep. 25, 2018

(54) FLEXIBLE POUCH WITH FRANGIBLE SEAL FOR HYDROGENATED WATER

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 0 days.

(21) Appl. No.: 14/830,427

(22) Filed: Aug. 19, 2015

(65) Prior Publication Data

US 2016/0052705 A1 Feb. 25, 2016

Related U.S. Application Data

(60) Provisional application No. 62/039,038, filed on Aug. 19, 2014.

(51) Int. Cl.

| | |
|---|---|
| ***B65D 85/72*** | (2006.01) |
| ***B65D 75/00*** | (2006.01) |
| ***B65D 75/58*** | (2006.01) |
| ***B65D 81/32*** | (2006.01) |

(52) U.S. Cl.

CPC ..... *B65D 85/72* (2013.01); *B65D 75/008* (2013.01); *B65D 75/5883* (2013.01); *B65D 81/3266* (2013.01)

(58) Field of Classification Search

CPC .. B65D 85/72; B65D 85/008; B65D 85/5883; B65D 81/3266

USPC ..... 222/94, 212, 206, 107, 153.06, 541.1, 222/541.6, 541.4, 541.3, 92; 383/104, 383/906

See application file for complete search history.

(56) References Cited

U.S. PATENT DOCUMENTS

| | | | | | |
|---|---|---|---|---|---|
| 4,537,308 | A * | 8/1985 | Hollander, Jr. | B65D 75/5822 | 206/219 |
| 4,759,472 | A * | 7/1988 | Strenger | B65D 75/5822 | 222/541.4 |
| 4,786,190 | A * | 11/1988 | Van Erden | B65D 75/20 | 206/260 |
| 4,798,605 | A * | 1/1989 | Steiner | A61J 1/10 | 222/83 |
| 4,818,544 | A * | 4/1989 | Seward | B65D 85/8043 | 206/0.5 |
| 4,890,744 | A * | 1/1990 | Lane, Jr. | B65D 75/5822 | 206/484 |
| 5,072,855 | A * | 12/1991 | Herzig | B65D 47/2037 | 222/212 |
| 5,373,966 | A * | 12/1994 | O'Reilly | B31B 41/00 | 206/484 |

(Continued)

*Primary Examiner* — Patrick M Buechner
*Assistant Examiner* — Michael J Melaragno
(74) *Attorney, Agent, or Firm* — Dinsmore & Shohl LLP

(57) ABSTRACT

A flexible pouch having a fitment for accessing the hydrogen water mounted in the corner of the pouch. A frangible seal is disposed between the contents of the pouch and the fitment. The frangible seal is placed on the pouch before the hydrogen water is filled into the pouch. The seal is placed just above the level of the hydrogenated water so as to minimize the amount of oxygen that can enter the pouch and contact the hydrogen water and also to prevent the hydrogenated water from coming into contact with the fitment and cap where the hydrogen can escape due to the fitment and cap having little or no barrier properties.

9 Claims, 5 Drawing Sheets

(56) References Cited

U.S. PATENT DOCUMENTS 5,971,613 A * 10/1999 Bell ..... B29C 65/18 383/104
6,645,191 B1 * 11/2003 Knerr ..... A61J 1/2093 604/410
7,040,483 B2 * 5/2006 Inuzuka ..... B65D 75/5855 206/219
8,181,823 B2 * 5/2012 Fukuizumi ..... B31B 19/84 206/484
8,418,884 B2 * 4/2013 Kasai ..... B65D 75/5866 222/107
9,004,761 B2 * 4/2015 Balteau ..... A61J 1/2093 206/219
2004/0057637 A1 * 3/2004 Nishibe ..... B65D 75/5894 383/66
2004/0134802 A1 * 7/2004 Inoue ..... B65D 81/3272 206/219
2004/0223801 A1 * 11/2004 Detwiler ..... A45D 34/04 401/132
2005/0087456 A1 * 4/2005 Oka ..... A61J 1/2093 206/219
2005/0147329 A1 * 7/2005 Arvizu ..... B65B 9/08 383/104
2005/0271306 A1 * 12/2005 Murray ..... B29C 65/08 383/38
2006/0127549 A1 * 6/2006 Murray ..... B65D 75/5827 426/393
2006/0196784 A1 * 9/2006 Murray ..... B65B 43/465 206/219
2007/0047851 A1 * 3/2007 Sato ..... B29C 45/14336 383/104
2007/0060903 A1 * 3/2007 Miyajima ..... A61J 1/1475 604/410
2008/0276645 A1 * 11/2008 Murray ..... B65B 43/465 62/530
2008/0302751 A1 * 12/2008 Segovia, Jr. ..... A61J 9/001 215/11.3
2009/0028470 A1 * 1/2009 Murray ..... B31B 19/84 383/80
2009/0095369 A1 * 4/2009 Murray ..... A23L 3/02 141/5
2009/0246290 A1 * 10/2009 Ohta ..... A23L 2/52 424/600
2009/0255626 A1 * 10/2009 Murray ..... B65B 61/186 156/253
2010/0150478 A1 * 6/2010 Murray ..... B65D 47/147 383/42
2010/0209025 A1 * 8/2010 Futase ..... B65D 75/008 383/113
2011/0049184 A1 * 3/2011 Futase ..... B65D 31/02 222/566
2011/0108572 A1 * 5/2011 Murray ..... B65D 75/5877 222/83
2011/0110613 A1 * 5/2011 Futase ..... B65D 75/5866 383/42
2011/0152051 A1 * 6/2011 Murray ..... B31B 19/84 493/213
2012/0008884 A1 * 1/2012 Murray ..... B31B 23/00 383/104
2012/0106878 A1 * 5/2012 Murray ..... B65D 75/008 383/104
2012/0125947 A1 * 5/2012 Becker ..... B65D 75/56 222/105
2013/0001252 A1 * 1/2013 Murray ..... B65D 75/5883 222/107
2013/0015091 A1 * 1/2013 Murray ..... B31B 1/00 206/459.5
2013/0016925 A1 * 1/2013 Murray ..... B31B 1/00 383/109
2013/0153448 A1 * 6/2013 Yoshikawa ..... A61J 1/10 206/219
2013/0195382 A1 * 8/2013 Murray ..... B65D 75/008 383/10
2013/0202228 A1 * 8/2013 Murray ..... B65G 47/61 383/42
2013/0292385 A1 * 11/2013 Murray ..... B65D 51/28 220/521
2014/0124532 A1 * 5/2014 Murray ..... B65D 75/5883 222/92
2014/0199002 A1 * 7/2014 Murray ..... B65D 33/02 383/119
2014/0246455 A1 * 9/2014 Murray ..... B67D 3/0067 222/107
2014/0252033 A1 * 9/2014 Murray ..... B65D 35/28 222/107
2014/0270577 A1 * 9/2014 Murray ..... B65D 33/004 383/5
2014/0353182 A1 * 12/2014 Murray ..... B65D 75/5883 206/223
2014/0367295 A1 * 12/2014 Murray ..... B31B 1/00 206/459.5
2015/0030264 A1 * 1/2015 Murray ..... B65D 75/008 383/105
2015/0086138 A1 * 3/2015 Murray ..... B65D 33/02 383/120
2015/0108015 A1 * 4/2015 Murray ..... B31B 1/00 206/205
2015/0210436 A1 * 7/2015 Murray ..... B65D 31/12 383/38
2015/0307233 A1 * 10/2015 Murray ..... B65D 31/12 383/38
2015/0360839 A1 * 12/2015 Murray ..... B65D 77/225 383/7
2016/0039575 A1 * 2/2016 Murray ..... B65D 27/08 206/204
2016/0052705 A1 * 2/2016 Murray ..... B65D 85/72 206/277
2016/0083145 A1 * 3/2016 Murray ..... B31B 29/60 383/105
2016/0090213 A1 * 3/2016 Murray ..... B65D 27/04 705/317
2016/0096666 A1 * 4/2016 Murray ..... B65D 75/5883 206/540
2016/0099753 A1 * 4/2016 Murray ..... H04B 5/0062 455/41.1
2016/0152392 A1 * 6/2016 Murray ..... B65D 75/52 383/100
2016/0280439 A1 * 9/2016 Murray ..... B65D 75/008

* cited by examiner

FLEXIBLE POUCH WITH FRANGIBLE SEAL FOR HYDROGENATED WATER

CROSS-REFERENCE TO RELATED APPLICATIONS

This Application claims the benefit of U.S. Provisional Application 62/039,038 filed on Aug. 19, 2014, the contents of which are incorporated in its entirety.

FIELD OF THE INVENTION

The present invention relates generally to pouches. More specifically, the present invention relates to a flexible pouch for storing and transporting hydrogenated water.

BACKGROUND OF THE INVENTION

Hydrogen-rich water is being transported and stored in a variety of containers including flexible pouches. Hydrogen rich water can be produced by placing a metallic magnesium (99.9%) stick into drinking water (hydrogen concentration—0.55#-0.65#mm) by the following reaction: $Mg+2H_2O \rightarrow Mg(OH)2+H_2$. Water can also be infused with hydrogen through other methods known to those in the industry. Hydrogen has to be produced constantly so that the water in the pouch retains high levels of hydrogen. However, hydrogen can be diffused in the water by oxygen. Therefore, the packaging of hydrogen water must be carefully done to ensure sufficient shelf life. Many of the current packages have a short shelf life because of the ingress of oxygen into the package which then contacts the water and diffuses hydrogen in the hydrogen water.

A flexible pouch having a fitment for accessing the hydrogen water mounted in the corner of the pouch. A frangible seal is disposed between the contents of the pouch and the fitment. The frangible seal is placed on the pouch before the hydrogen water is filled into the pouch. The seal is placed just above the level of the hydrogen water so as to minimize the amount of oxygen that can enter the pouch and contact the hydrogen water and also to prevent the water from coming into contact with the fitment and cap where the hydrogen can escape due to the fitment and cap having no barrier properties. The pouch may have a fold line to assist the user in breaking the seal to access the hydrogen water.

A pouch is adapted to hold a supply of hydrogenated fluid. The pouch includes a first wall and a second wall forming a compartment, the compartment adapted to hold the supply of hydrogenated fluid. An opening to the compartment is also provided. A frangible seal is positioned between the opening to the compartment and the supply of hydrogenated fluid, the frangible seal adapted to prevent the supply of hydrogenated fluid from contacting the opening so as to prevent the escape of hydrogen from the water.

In one embodiment, the seal is generally half circular shaped, the seal positioned between the supply of hydrogenated fluid and the opening. In another embodiment, the seal is straight, the seal positioned between the supply of hydrogenated fluid and the opening, the seal connected with at least one side seal of the pouch. Furthermore, the cap can be sealed into the pouch, the seal positioned between the cap and the supply of hydrogenated fluid so as to prevent any hydrogenated fluid from contacting the cap. The frangible seal is broken upon a squeezing force supplied by the user prior to drinking the fluid.

In a slightly varied embodiment, a flexible pouch in provided having a compartment adapted to hold a supply of fluid, an opening to the compartment and a frangible seal positioned between the opening to the compartment and the supply of fluid, the frangible seal positioned to prevent the supply of fluid from contacting the opening of the compartment. The fluid can be any liquid or gas suitable to fit in the pouch. The seal is configured in any manner such as discussed above.

In another slightly varied embodiment, a pouch is provided adapted to hold a supply of fluid wherein the fluid is infused with a gas. The fluid can be any fluid capable of holding a gas and capable of fitting into a pouch. The pouch may be flexible or otherwise hard walled. The pouch includes a first wall and a second wall forming a compartment, the compartment adapted to hold the supply of fluid, an opening to the compartment and a frangible seal positioned between the opening to the compartment and the supply of hydrogenated fluid, the frangible seal adapted to prevent the supply of hydrogenated fluid from contacting the opening so as to prevent the escape of gas from the fluid.

The fluid can be any liquid or gas suitable to fit in the pouch. The seal is configured such as discussed above. In some embodiment, a cap (or fitment) positioned on an upper edge of the pouch where the seal expends generally horizontally between two sealed side portions of the pouch, the seal positioned between the supply of fluid and the cap. In other embodiments, the cap positioned on an angled corner of the pouch wherein the seal is angled generally at a 45 degree angle, a pair of ends extending between the side seals of the pouch. In even further embodiments, the ends of the seal extend between at least one side seal of the pouch.

DETAILED DESCRIPTION OF THE PREFERRED EMBODIMENTS

Thus a novel pouch and method of manufacturing the pouch includes a flexible pouch having a fitment for accessing the hydrogen water mounted in the corner of the pouch. A frangible seal is disposed between the contents of the pouch and the fitment. The frangible seal is placed on the pouch before the hydrogen water is filled into the pouch. The seal is placed just above the level of the hydrogen water so as to minimize the amount of oxygen that can enter the pouch and contact the hydrogen water and also to prevent the water from coming into contact with the fitment and cap where the hydrogen can escape due to the fitment and cap having no barrier properties. The pouch may have a fold line to assist the user in breaking the seal to access the hydrogen water.

Figure 1:
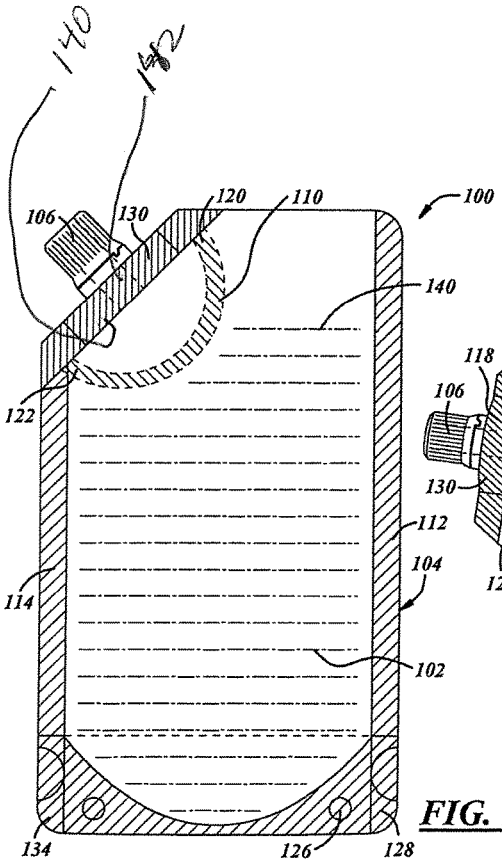
FIG. 1 illustrates a front view of a first embodiment.
Figure 2:
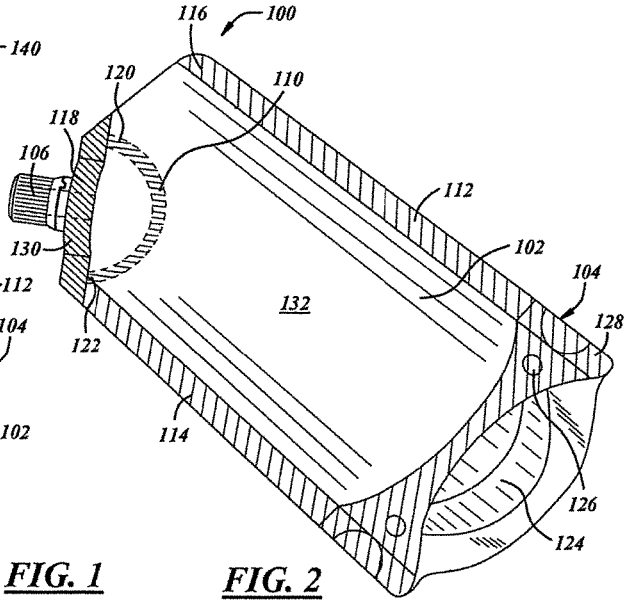
FIG. 2 illustrates a perspective view of the first embodiment.

A number of embodiments of the pouch are shown in FIGS. 1-10. As shown in FIGS. 1 and 2, a stand-up flexible pouch having a bottom gusset, a front panel and a rear panel.

The first embodiment as illustrated in FIGS. 1 and 2 include the pouch 100 having a first panel 102 and a second panel 104. The panels are sealed together by means of the various seals 112, 114, 130. A fitment 140 with a cap 106 is provided at the upper corner 130 of the pouch 130. The fitment 140 has a passage 142. A frangible seal 110 is positioned between a supply of hydrogenated water 140 and the cap 106. The seal 110 is adapted to prevent hydrogen from the water to escape through the cap 106. When the user wants to drink the water, the frangible seal is broken by the use squeezing the pouch to break the seal.

In this first embodiment, the pouch 100 includes corner portions 128, 134, 116 and 130. The corner portion 130 includes the cap 106. In this embodiment, a gusset 124 is provided to allow the pouch to stand in an upright position.

Figure 3:
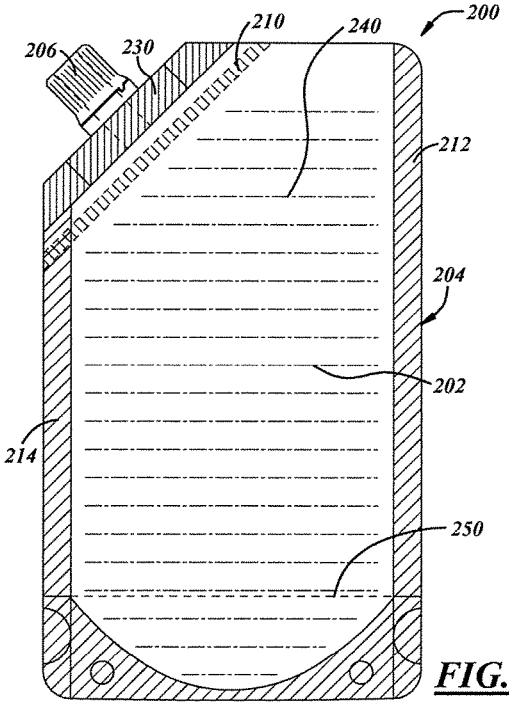
FIG. 3 illustrates a front view of a second embodiment having a straight seal.

The panels are formed from a film laminate including a layer of aluminum or silicon oxide. The laminate may be PET/AL/NY/LLDPE; PETALOx/NY/LLDPE; or PETSiOx/NY/LLDPE. The film structure is also very important. Film with barrier properties prevents the hydrogen from escaping through the pouch. The film is formed into a pouch having three sides on a conventional pouch making machine. The fitment is heat sealed or ultra-sonically welded to an upper corner of the pouch. A frangible seal is formed to extend from the corner seal from one side of the fitment to the other side of the fitment. The pouch has an open top. The empty pouch moves around the turret and a diving nozzle enters into the opening at the top of the pouch and disperses the hydrogenated water into the pouch. The pouch travels to the next station where seal bars are moved inwardly against the pouch to place a seal horizontally across the top of the pouch sealing the front panel to the rear panel just above the level of the hydrogen water. The fitment has a top which is removable to permit access to the contents of the pouch. The fitment may be provided with a childproof or tamperproof feature to prevent ready access to or tampering of the product. As shown in FIG. 3, the user folds the bottom of the pouch (as illustrated at reference line 250) to produce pressure in the pouch to burst the frangible seal around the fitment.

A second embodiment is shown in FIG. 3. The pouch is a stand-up pouch but has a straight frangible seal which is spaced downwardly and parallel with the bottom edge of the fitment.

The second embodiment as illustrated in FIG. 3 includes the pouch 200 having a first panel 202 and a second panel 204. The panels are sealed together by means of the various seals 212, 214, 230. A cap 206 is provided at the upper corner 230 of the pouch 230. A frangible seal 210 is positioned between a supply of hydrogenated water 240 and the cap 206. The seal 210 is adapted to prevent hydrogen from the water to escape through the cap 206. When the user wants to drink the water, the frangible seal is broken by the use squeezing the pouch to break the seal.

Figure 4:
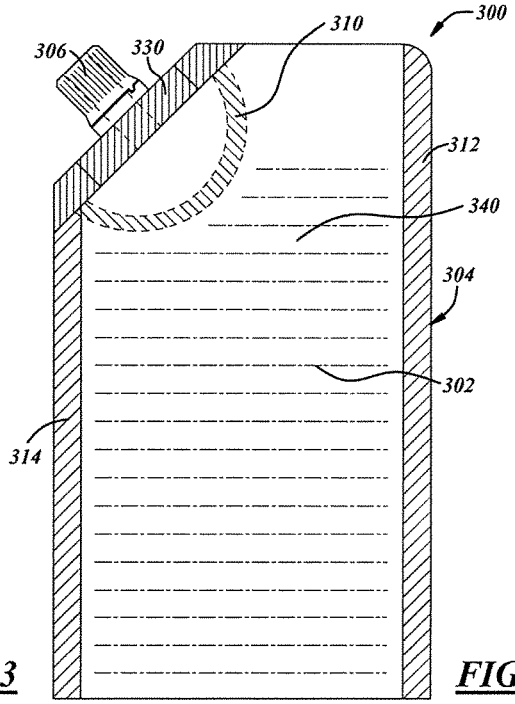
FIG. 4 illustrates a front view of a third embodiment having a curved seal.

A third embodiment of the invention having a curved seal and straight bottom without a gusset is shown in FIG. 4. The third embodiment as illustrated in FIG. 4 includes the pouch 300 having a first panel 302 and a second panel 304. The panels are sealed together by means of the various seals 312, 314, 330. A cap 306 is provided at the upper corner of the pouch 300. A frangible seal 310 is positioned between a supply of hydrogenated water 340 and the cap 306. The seal 310 is adapted to prevent hydrogen from the water to escape through the cap 306. When the user wants to drink the water, the frangible seal is broken by the user squeezing the pouch to break the seal.

Figure 5:
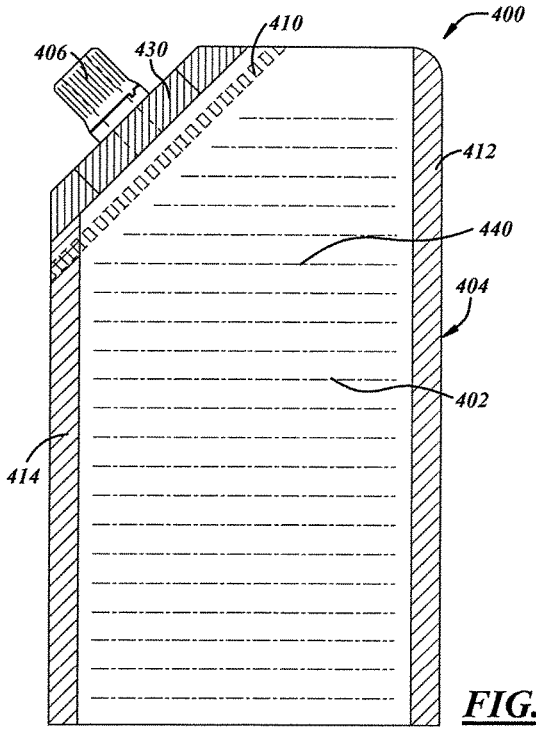
FIG. 5 illustrates a front view of a fourth embodiment having a straight seal.

A fourth embodiment of the invention having a straight frangible seal and a straight bottom is shown in FIG. 5.

The fourth embodiment as illustrated in FIG. 5 includes the pouch 400 having a first panel 402 and a second panel 404. The panels are sealed together by means of the various seals 412, 414, 430. A cap 406 is provided at the upper corner 430 of the pouch 430. A frangible seal 410 is positioned between a supply of hydrogenated water 440 and the cap 406. The seal 410 is adapted to prevent hydrogen from the water to escape through the cap 406. When the user wants to drink the water, the frangible seal is broken by the use squeezing the pouch to break the seal.

A fifth embodiment is similar to the first in that the pouch has a fitment with a closure on the top of the pouch. The fitment is installed and a curved frangible seal is formed to extend outwardly from the top seal 130. The pouch then is loaded into a turret with the bottom of the pouch open but facing upwardly. The pouch then is moved to a fill station where a diving nozzle fills the hydrogen water into the pouch. The pouch is moved to a final seal station where a horizontal seal is placed across the open edges of the inverted pouch to seal the water into the pouch.

Figure 6:
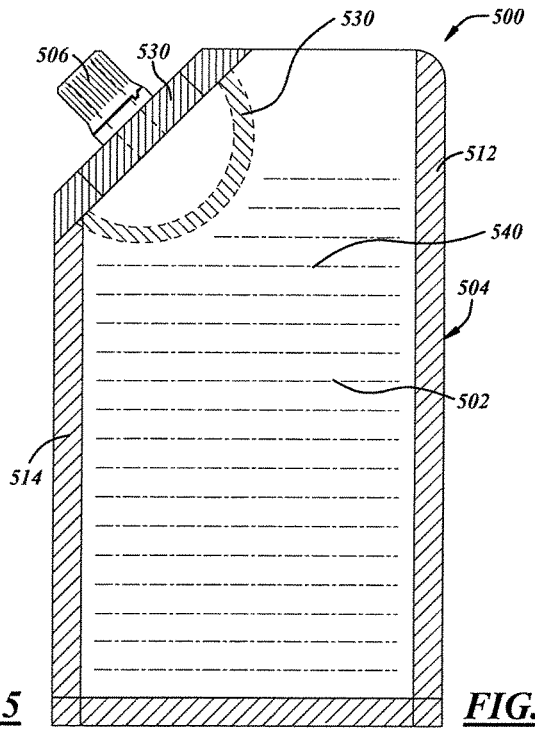
FIG. 6 illustrates a front view of a fifth embodiment having a curved seal.

The fifth embodiment as illustrated in FIG. 6 includes the pouch 500 having a first panel 502 and a second panel 504. The panels are sealed together by means of the various seals 512, 514, 530. A cap 506 is provided at the upper corner 530 of the pouch 530. A frangible seal 510 is positioned between a supply of hydrogenated water 540 and the cap 506. The seal 510 is adapted to prevent hydrogen from the water to escape through the cap 506. When the user wants to drink the water, the frangible seal is broken by the use squeezing the pouch to break the seal.

In all embodiments, the pouch is filled with the hydrogenated water at a fill station having a hood positioned above. The hood is adapted to control the filling environment to prevent the hydrogen from escaping the water. In one embodiment, the pouch is filled when the hood emits nitrogen. The nitrogen replaces the air at the filling station. Since nitrogen is an inert gas, it will not mix with the hydrogen in the water. Accordingly, nitrogen fills the space in the pouch not occupied by the hydrogenated water so as to prevent the hydrogen from escaping the water.

Figure 7:
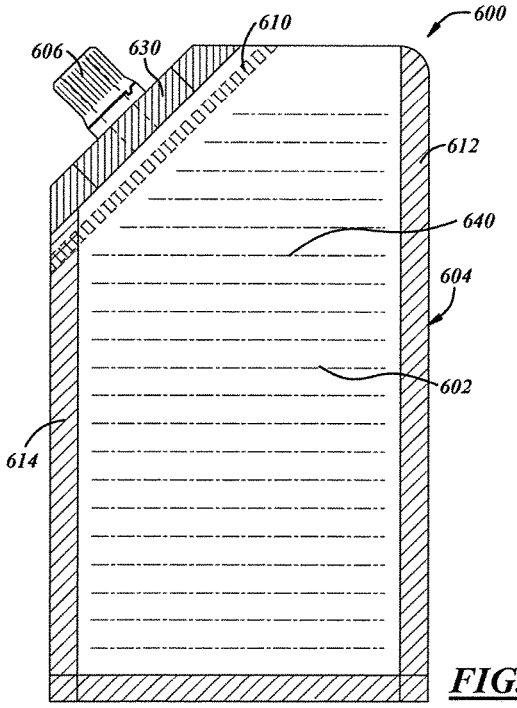
FIG. 7 illustrates a front view of a sixth embodiment having a straight seal.

A sixth embodiment is shown in FIG. 7. The sixth embodiment as illustrated in FIG. 7 includes the pouch 600 having a first panel 602 and a second panel 604. The panels are sealed together by means of the various seals 612, 614, 630. A cap 606 is provided at the upper corner of the pouch 630. A frangible seal 610 is positioned between a supply of hydrogenated water 640 and the cap 606. The seal 610 is adapted to prevent hydrogen from the water to escape through the cap 606. When the user wants to drink the water, the frangible seal is broken by the use squeezing the pouch to break the seal.

Figure 8:
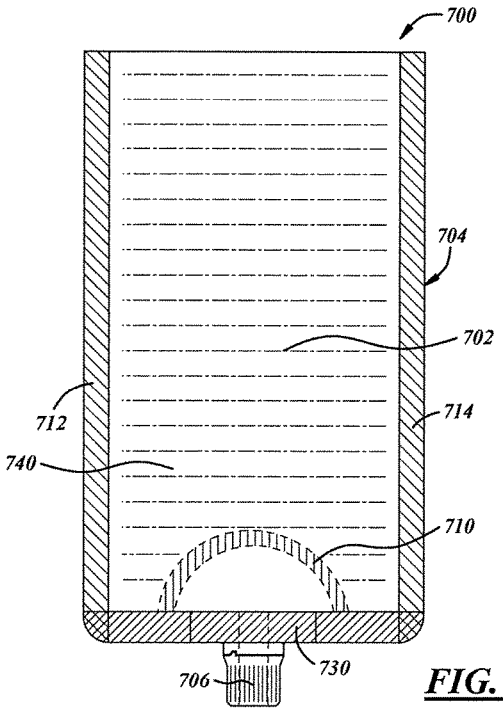
FIG. 8 illustrates a front view of a seventh embodiment having a curved seal.

A seventh embodiment is shown in FIG. 8. The seventh embodiment as illustrated in FIG. 7 includes the pouch 700 having a first panel 702 and a second panel 704. The panels are sealed together by means of the various seals 712, 714, 730. A cap 706 is provided at the lower edge of the pouch 700. A frangible seal 710 is positioned between a supply of hydrogenated water 740 and the cap 706. The seal 710 is adapted to prevent hydrogen from the water to escape through the cap 706. When the user wants to drink the water, the frangible seal is broken by the user squeezing the pouch to break the seal.

Figure 9:
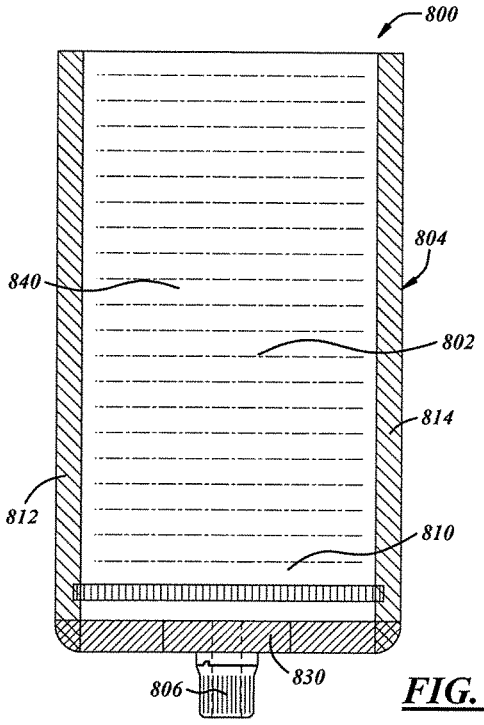
FIG. 9 illustrates a front view of a eighth embodiment having a straight seal.

An eighth embodiment is shown in FIG. 9. The eighth embodiment as illustrated in FIG. 9 includes the pouch 800 having a first panel 802 and a second panel 804. The panels are sealed together by means of the various seals 812, 814, 830. A cap 806 is provided at the lowed edge of the pouch 800. A frangible seal 810 is positioned between a supply of hydrogenated water 840 and the cap 806. The seal 810 is adapted to prevent hydrogen from the water to escape through the cap 806. When the user wants to drink the water, the frangible seal is broken by the user squeezing the pouch to break the seal.

Figure 10:
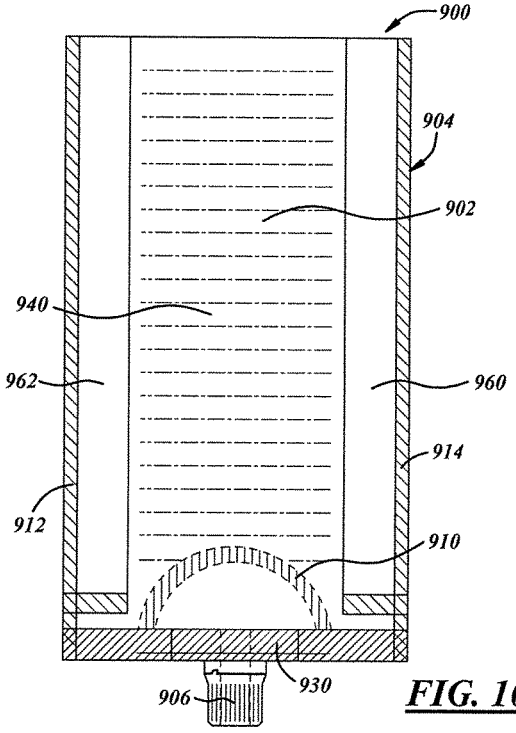
FIG. 10 illustrates a front view of a ninth embodiment having a curved seal.

A ninth alternative embodiment is shown in FIG. 10. The pouch includes a pair of side gussets 960, 962 which results in a generally rectangular shape. The ninth embodiment as illustrated in FIG. 10 includes the pouch 900 having a first panel 902 and a second panel 904. The panels are sealed together by means of the various seals 912, 914, 330. A cap 906 is provided at the lower edge of the pouch 900. A frangible seal 910 is positioned between a supply of hydrogenated water 940 and the cap 906. The seal 910 is adapted to prevent hydrogen from the water to escape through the cap 906. When the user wants to drink the water, the frangible seal is broken by the user squeezing the pouch to break the seal.

When the pouch is ready for use by the consumer, the pouch is folded over at the frangible seal to promote rupturing of the seal or the contents are squeezed against the seal to rupture the frangible seal. The fitment is then opened and the contents are ready to be consumed by the consumer. The inner frangible seal prevents the hydrogenated water from reaching the fitment and cap where the hydrogen in the water can escape through the fitment and cap that both have very little barrier properties. The inner frangible seal also prevents oxygen from reaching the contents and thereby diffusing the contents.

The invention is not restricted to the illustrative examples and embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the appended claims.

The invention claimed is:

1. A pouch comprising:

a first wall and a second wall forming a compartment;

a fitment mounted between the first wall and second wall, the fitment having a fluid passage;

a cap removably mounted to the fitment, the cap being selectively removable to provide access to the compartment through the passage in the fitment, a supply of hydrogenated water disposed in the compartment; and a frangible seal formed in the first wall and second wall between the fitment and the supply of hydrogenated water, the frangible seal adapted to prevent the supply of hydrogenated water from contacting the fitment so as to prevent the escape of hydrogen from the hydrogenated water through the fitment and surround seals.

2. The pouch of claim 1 wherein the seal is generally half circular shaped, the seal positioned between the supply of hydrogenated fluid and the fitment.

3. The pouch of claim 1 wherein the seal is straight, the seal positioned between the supply of hydrogenated fluid and the fitment, the seal connected with at least one side seal of the pouch.

4. The pouch of claim 1 wherein the opening is a cap, the cap sealed into the pouch, the seal positioned between the cap and the supply of hydrogenated fluid so as to prevent any hydrogenated fluid from contacting the cap.

5. The pouch of claim 1 wherein the frangible seal is broken upon a squeezing force supplied by the user prior to drinking the fluid.

6. The pouch of claim 1 wherein the opening is a cap, the cap positioned on an upper edge of the pouch.

7. The pouch of claim 1 wherein the seal expends generally horizontally between two sealed side portions of the pouch, the seal positioned between the supply of hydrogenated water and the cap.

8. The pouch of claim 1 wherein the fitment is positioned on an angled corner of the pouch.

9. The pouch of claim 8 wherein the seal is angled generally at a 45 degree angle.

* * * * *